US009894998B2

(12) United States Patent
Walser

(10) Patent No.: US 9,894,998 B2
(45) Date of Patent: Feb. 20, 2018

(54) TILTABLE STOOL

(71) Applicant: Inventor Group GmbH, Wollerau (CH)

(72) Inventor: Thomas Walser, Kreuzlingen (CH)

(73) Assignee: Inventor Group GmbH, Wollerau (CH)

( * ) Notice: Subject to any disclaimer, the term of this patent is extended or adjusted under 35 U.S.C. 154(b) by 222 days.

(21) Appl. No.: 14/889,432

(22) PCT Filed: Jan. 11, 2015

(86) PCT No.: PCT/IB2015/050203

§ 371 (c)(1),
(2) Date: Nov. 5, 2015

(87) PCT Pub. No.: WO2015/104686

PCT Pub. Date: Jul. 16, 2015

(65) Prior Publication Data

US 2016/0088944 A1 Mar. 31, 2016

Related U.S. Application Data

(63) Continuation-in-part of application No. 29/508,750, filed on Nov. 10, 2014, now Pat. No. Des. 748,924.

(30) Foreign Application Priority Data

Jan. 12, 2014 (DE) ..... 20 2014 00 0079 U
Aug. 20, 2014 (EM) ..... 002522284

(51) Int. Cl.
*A47C 3/02* (2006.01)
*A47C 9/00* (2006.01)
(Continued)

(52) U.S. Cl.
CPC ..... *A47C 3/02* (2013.01); *A47C 3/026* (2013.01); *A47C 3/029* (2013.01); *A47C 3/20* (2013.01);
(Continued)

(58) Field of Classification Search
CPC ..... A47C 9/00; A47C 9/025; A47C 9/002; A47C 3/02; A47C 3/026; A47C 3/029; A47C 7/008; A47C 7/004
(Continued)

(56) References Cited

U.S. PATENT DOCUMENTS 513,584 A 1/1894 Leisenring
1,228,615 A * 6/1917 Stafford ..... E01F 9/629 116/173
(Continued)

FOREIGN PATENT DOCUMENTS

DE 29702389 U1 4/1997
DE 102010060095 A1 4/2012
EP 0824006 A2 2/1998

*Primary Examiner* — Milton Nelson, Jr.
(74) *Attorney, Agent, or Firm* — Smartpat PLC

(57) ABSTRACT

An improved tiltable stool comprises a seat, a body structure, and a base. The base comprises an annular elastic base member having a downwardly convex outer surface and a downwardly concave inner surface. Deformation of the annular elastic base causes a stabilizing force which pushes the tiltable stool towards a normal position when the tiltable stool or chair is tilted out of the normal position. The stabilizing force increases with the weight of a user and provides a consistent dynamic seating experience for users of different weights. An upper section of the annular elastic base is substantially cylindrical and firmly connected to the base structure. The downwardly convex outer surface of a lower section of the annular elastic base member rests on the floor. A contact area between the annular elastic base member and the floor is substantially ring-shaped, and grows outwardly with an increasing weight placed on the seat.

21 Claims, 7 Drawing Sheets

(51) Int. Cl.

| | |
|---|---|
| ***A47C 7/00*** | (2006.01) |
| ***A47C 3/20*** | (2006.01) |
| ***A47C 3/026*** | (2006.01) |
| ***A47C 3/029*** | (2006.01) |
| ***A47C 9/02*** | (2006.01) |

(52) U.S. Cl.
CPC ..... *A47C 7/004* (2013.01); *A47C 7/008* (2013.01); *A47C 9/002* (2013.01); *A47C 9/025* (2013.01)

(58) Field of Classification Search
USPC ..... 297/258.1, 314, 462
See application file for complete search history.

(56) References Cited

U.S. PATENT DOCUMENTS

| | | | | |
|---|---|---|---|---|
| 3,295,621 | A | 1/1967 | Deeley et al. | |
| 3,309,137 | A | 3/1967 | Wiebe | |
| 3,312,437 | A | 4/1967 | Valerie | |
| D225,283 | S | 11/1972 | Axelrod | |
| 4,130,263 | A | 12/1978 | Roericht | |
| D283,856 | S | 5/1986 | Elmaleh | |
| D292,147 | S | 10/1987 | Lomedico et al. | |
| D313,896 | S | 1/1991 | Kaye | |
| 5,044,587 | A | 9/1991 | Degen | |
| D381,821 | S | 8/1997 | Miles | |
| 5,746,481 | A | 5/1998 | Obermaier | |
| D454,438 | S | 3/2002 | Volkman et al. | |
| D454,706 | S | 3/2002 | Volkman et al. | |
| 6,644,742 | B1 | 11/2003 | Walser | |
| D530,531 | S | 10/2006 | Kita | |
| D565,313 | S * | 4/2008 | Johnsen | D6/349 |
| D671,772 | S | 12/2012 | Lee et al. | |
| 8,540,314 | B2 * | 9/2013 | Fernandez | A47C 3/30 297/314 |
| D720,143 | S | 12/2014 | Barber et al. | |
| 2011/0221255 | A1 | 9/2011 | Weber et al. | |
| 2013/0320727 | A1 | 12/2013 | Martin et al. | |
| 2013/0334846 | A1 | 12/2013 | Bahneman et al. | |
| 2016/0331144 | A1 * | 11/2016 | Murray | A47C 7/566 |

* cited by examiner

TILTABLE STOOL

TECHNICAL FIELD

The present invention generally relates to an article of furniture, and more particularly, to a tiltable stool or chair which self-adjusts to the weight of a user.

BACKGROUND

Articles of furniture such as stools or chairs which allow a user to rock forward, backward and sideways are generally known. A tiltable stool is typically configured to be used on a generally horizontal surface such as a floor. The stool comprises a top section providing seat and a base section comprising a rounded bottom surface configured to support the stool on the floor.

The base section may be a weighted base which has a downwardly convex lateral surface area to support the stool upon contacting the floor when the stool is tilted out of its normal upright position. In that normal position the stool rests on the floor with a flat or concave area of its base. The weighting of the base is so chosen that the center of gravity of the stool comes to lie inwardly of the perimeter of the central contact area in its tilted state. The support areas may be contiguous, thus forming part of a continuous annular surface, or may be peripherally spaced apart, as by being individually disposed on three or more legs projecting generally radially from the base. Such stools are generally described in U.S. Pat. No. 3,312,437 and in US patent application publication US 2013/0320727.

The conventional stools typically assume an upright normal position when unoccupied. The upright position is obtained by a resetting force which acts on the stool when tilted out of its normal upright position. The resetting force is caused by coordinating the center of gravity of the stool with the fixed shape of its base such that the center of gravity assumes its lowest position when the stool is upright. Typically, the resetting force is selected based on a desired characteristic of an unoccupied stool.

The rounded base of conventional stools have several disadvantages: They may cause noise when the stool is tilted, they require a relatively large and heavy base. The base may slide or roll away due to a small contact surface with the floor, and the stool generally provides insufficient support for a user when tilting out of the upright position, making it undesirable or even dangerous in particular for elderly users.

Attempts have been made to address the inherent disadvantages of a fixedly formed rounded base by using an inflatable base. An exemplary seating arrangement having an inflatable rubber ring is disclosed in U.S. Pat. No. 6,644,742. The inflatable base requires occasional reinflation, which is not practical. It may also be prone to outgassing and cause an undesirable odor.

Also, bases made of foam have been proposed, but those do not address the lack of support for a user to maintain a generally upright seating position and do not adjust to a user's weight.

SUMMARY

An improved tiltable stool provides soft and comfortable dynamic seating without jeopardizing safety and stability. The stool is intended to be used while keeping both of a user's feet on the ground. When tilted out of a normal position the stool provides a stabilizing force which aides in maintaining a stable seating position. The stabilizing force of the stool increases approximately exponentially with the tilt angle of the stool out of the normal, typically upright, position. The stabilizing force also increases with the weight of a user. At a given tilt angle the stabilizing force increases approximately linearly with the weight of the user, thus making the stool self-adjust to the user's weight. The improved stool provides a similar seating experience for both light and heavy users: All users can easily tilt out of the normal position, while experiencing a stabilizing force with increasing tilt angle that corresponds to the user's weight. The improved tiltable stool provides dynamic seating flexibility similar to that of an exercise ball, but eliminates the inherent instability of sitting on a ball. Exercise balls have been associated with severe injuries when users have lost their balanced and fallen over backward. When the stool is unoccupied the stabilizing force is small and affected only by the weight of the stool, but sufficient to return a tilted stool into a normal position.

The improved stool comprises a seat, a body structure, and a base. The base comprises an annular elastic base member having a downwardly convex outer surface and a downwardly concave inner surface. The annular elastic base member is held in a base structure. The body structure extends between the seat and the base. Deformation of the annular elastic base causes a stabilizing force which pushes the tiltable stool towards a normal position when the tiltable stool or chair is tilted out of the normal position. An upper section of the annular elastic base is substantially cylindrical and firmly connected to the base structure. The downwardly convex outer surface of a lower section of the annular elastic base member rests on the floor. When the stool is upright a contact area between the annular elastic base member and the floor is substantially ring-shaped, and grows outwardly with an increasing weight placed on the seat.

Preferably, the annular elastic base member has a tapered cross-sectional shape with downwardly decreasing thickness. Typically, the normal position of the stool is upright. When the stool is upright the outer surface of an upper section of the annular elastic base member is substantially vertical. However, the normal position may also be selected such that the stool is biased out of the upright position.

A tongue-and-groove connection may be used to connect the annular elastic base member to the base structure. A circular tongue at the upper end of the annular elastic base member engages a corresponding circular groove of the base structure. The annular elastic base may be press-fitted, glued, welded, or mechanically fixed to the base structure. In particular, an electrically conductive disc may be disposed within the circular groove of the base structure. The annular elastic base member may be welded to the base structure by applying an electric current through the electrically conductive disc. Alternatively, the tongue of the annular elastic base may be inserted into the circular groove of the base structure by cooling the annular elastic base to reduce the width of the circular tongue.

The annular elastic base may be made of various elastic materials, and is preferably made of plastic, which may be reinforced by glass fibers. In particular, the annular elastic base may be made of thermoplastic polyurethane (TPU).

In alternative embodiments the stool may comprise an annular elastic base having an outwardly convex, substantially "j"-shaped cross section. Deformation of the annular elastic base affects a stabilizing force which increases with a tilt angle between a tilted seating position and the upright position. The stabilizing force may increase approximately exponentially with the tilt angle. The stabilizing force increases, preferably linearly, with a weight that is applied to the seat.

In yet another alternative embodiment the annular elastic base has a substantially "o"-shaped cross section. The annular elastic base may then comprise a pressurized cavity between an outer wall and an inner wall.

DETAILED DESCRIPTION

Figure 1:
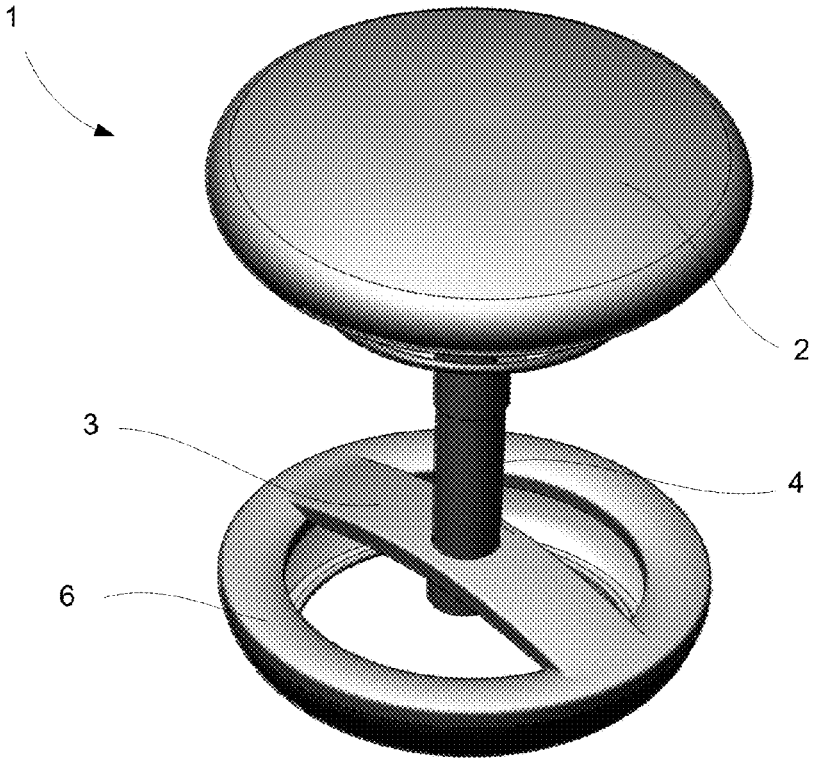
FIG. 1 is a perspective top view of an exemplary tiltable stool.
Figure 2:
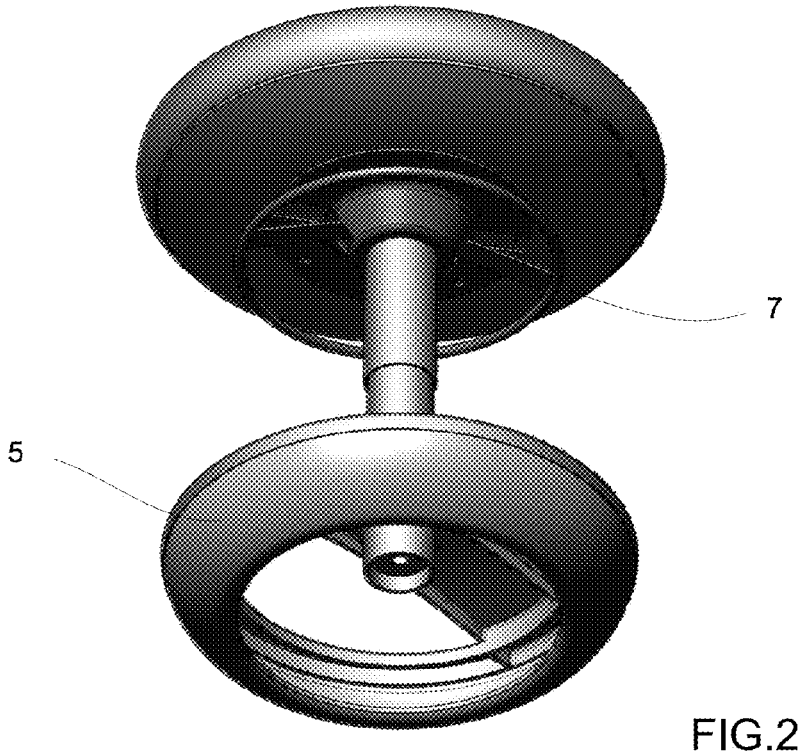
FIG. 2 is a perspective bottom view of the stool as in FIG. 1.
Figure 3:
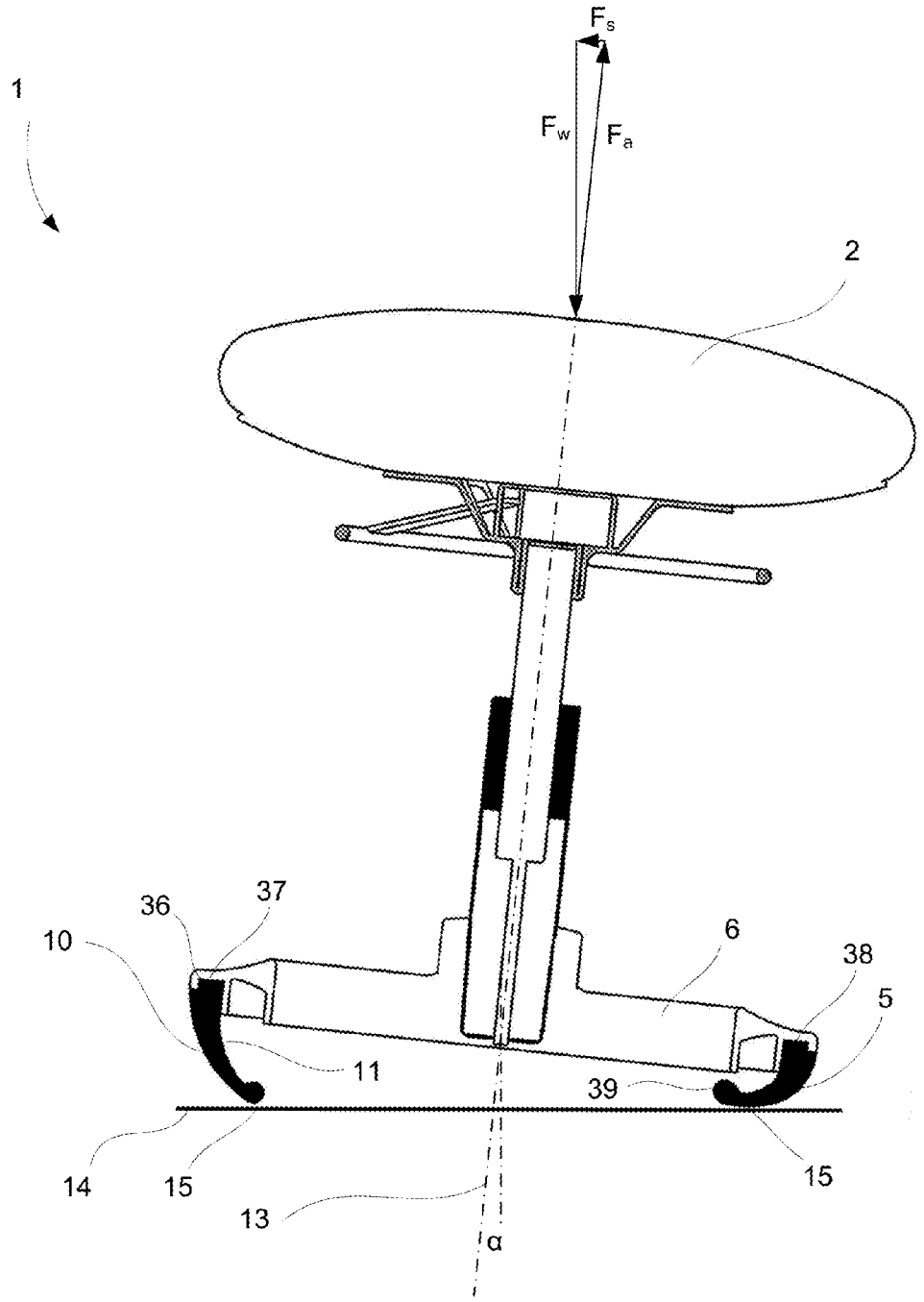
FIG. 3 is a cross sectional view of an exemplary tiltable stool, showing the stool in a tilted position.

Referring to FIGS. 1, 2 and 3, a tiltable stool 1 comprises a seat 2, a base 3, and an elongated body structure 4 between the base 3 and the seat 2. The stool 1 may comprise a height adjustment mechanism including an adjustment lever 7 to adjust the length of the body structure 4. The body structure 4 may comprise a pillar assembly and defines a vertical axis 13 of the stool 1.

The base 3 may comprising a base structure 6 connected to an annular elastic base member 5. The annular elastic base member 5 is configured to rest on the floor 14. The stool 1 is tiltable in any direction by deforming the annular elastic base member 5. When a tilting force is applied to the seat, the seat is moved from a normal position into a dynamic seating position. Typically, the normal position is upright. In the upright position the vertical axis 13 of the stool 1 is perpendicular to the floor 14. In response to a tilting force the annular elastic base member 5 is deformed, and the vertical axis 13 of the stool 1 is tilted by a tilt angle $\alpha$ out of the normal position. The annular elastic base member 5 may be rotationally symmetrical and extend around a central opening.

FIG. 3 shows a cross section of the stool 1 in a tilted seating position. Here, the stool 1 is tilted to the right by a tilt angle $\alpha$ out of the upright position. The annular elastic base member 5 is deformed and the height of the annular elastic base varies. As shown, the annular elastic base member 5 is compressed in the direction of the tilt (right side of FIG. 3) and expanded opposite the direction of the tilt (left side of FIG. 3). Compression of the annular elastic base member 5 causes a stabilizing force Fs at the seat 2 which counteracts the tilting force. In a stable tilted position the weight of the user Fw is countered by an axial force Fa in the direction of the vertical axis 13 and the stabilizing force Fs which is perpendicular to the axial force Fa.

The annular elastic base member 5 extends from a substantially circular upper end 38 to a lower end 39 around an opening. The diameter of the annular elastic base member 5 at the upper end 38 is larger than the diameter of the annular elastic base member 5 at the lower end 39. Beneficially, the diameter at the upper end 38 is between approximately 1.2 and 1.6 times that of the diameter at the lower end 39. The annular elastic base member 5 has a downwardly convex outer surface 10 and a downwardly concave inner surface 11. The outer surface 10 of the annular elastic base contacts the floor 14 at a contact area 15. The contact area 15 extends at a distance around the vertical axis 13. A tongue 36 may be formed at the upper end 38 of the annular elastic base member 5 which engages a corresponding groove 37 in the base structure 6 to firmly connect the annular elastic base member 5 to the base structure 6.

Figure 4:
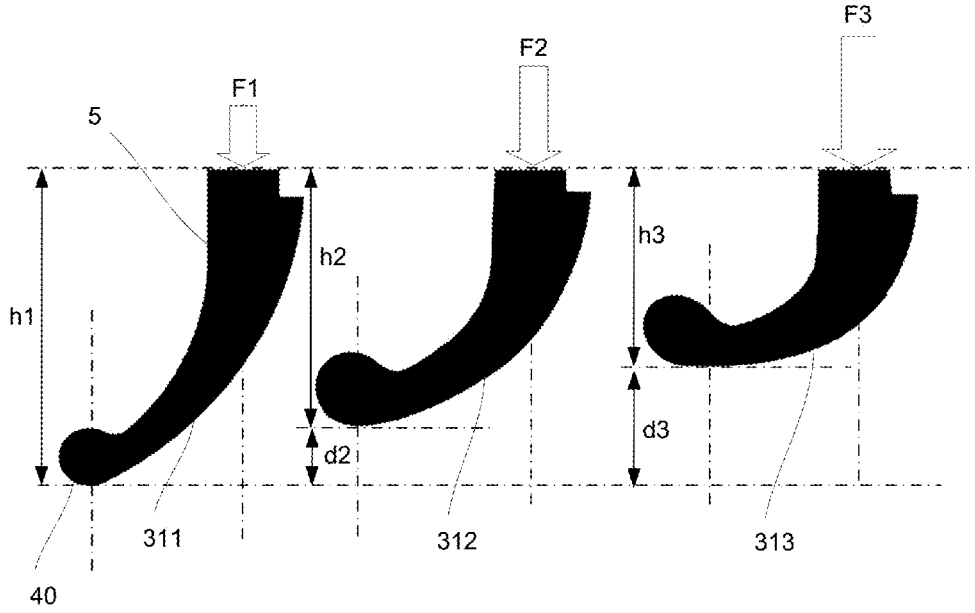
FIG. 4 is a detailed cross sectional view of an exemplary annular elastic base under various loads.

FIG. 4 shows the deformation of an exemplary annular elastic base member 5 under various loads in more detail. When a first force F1 of approximately 400 N/m is applied, the annular elastic base member 5 has a first height h1 and a first cross sectional shape 311. The first force F1 correlates to a person weighing about 40 kg sitting on a stool to which an annular elastic base member with a diameter of 320 mm is attached. As the stool is more heavily loaded, the annular elastic base member 5 is deformed. When loaded with a second force F2 of approximately 800 N/m, corresponding to a person with a weight of 80 kg sitting on the stool, the annular elastic base member assumes a second cross sectional shape 312. The height of the annular elastic base is reduced by a first deformation d2 to a second height h2. When further loaded with a third force F3 of approximately 1200 N/m, corresponding to a person with a weight of about 120 kg sitting on the stool, the annular elastic base member 5 assumes a third cross sectional shape 313. Under the third load F3 the height of the annular elastic base is reduced by a second deformation d3 to a third deformed height h3.

Figure 5:
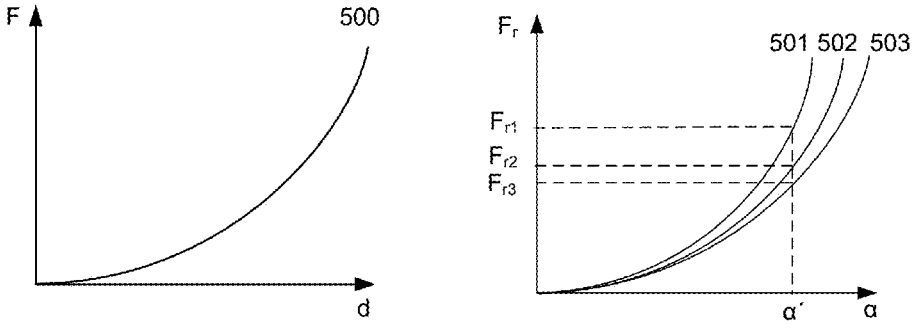
FIG. 5 shows diagrams illustrating the relationship between load and deformation of the annular elastic base and between tilt angle and stabilizing force.

The relationship between deformation d and load F of an annular elastic base is generally shown in FIG. 5. The relationship 500 between deformation d and load F is non-linear. More specifically, with increasing deformation d the load F grows approximately exponentially. The non-linear relationship between load F and deformation d allows users of vastly different weight to use a stool equipped with the annular elastic base, without significantly affecting the overall height of the stool.

Tilting a stool by an angle $\alpha$ out of the normal position causes a stabilizing force opposite the direction of tilt. The relationship between tilt angle $\alpha$ and stabilizing force Fr is generally shown in curves 501, 502 and 503 shown in FIG. 5. As illustrated, the stabilizing force is zero when the stool is in an upright position, allowing a user to easily tilt. The stabilizing force Fr increases with increasing tilt angle $\alpha$ as shown in curves 501, 502 and 503. The different curves show the stabilizing force for users of different weight. As shown, the first curve 501 illustrates the stabilizing force for a heavy user weighing 120 kg. The second curve 502 illustrates the stabilizing force for a medium user weighing 80 kg. The third curve 503 illustrates the stabilizing force for a light user weighing 40 kg. At a given tilt angle $\alpha'$ the stabilizing force $F_{r1}$ experience by the heavy user is larger than the stabilizing force $F_{r2}$ experienced by the medium user, which in turn is larger than the stabilizing force $F_{r3}$ experienced by the light user. This desired effect provides a similar seating experience for users of various weights. It provides additional stabilizing support for heavier users without impeding the ability of lighter users to reach the same tilt angle.

Figure 6:
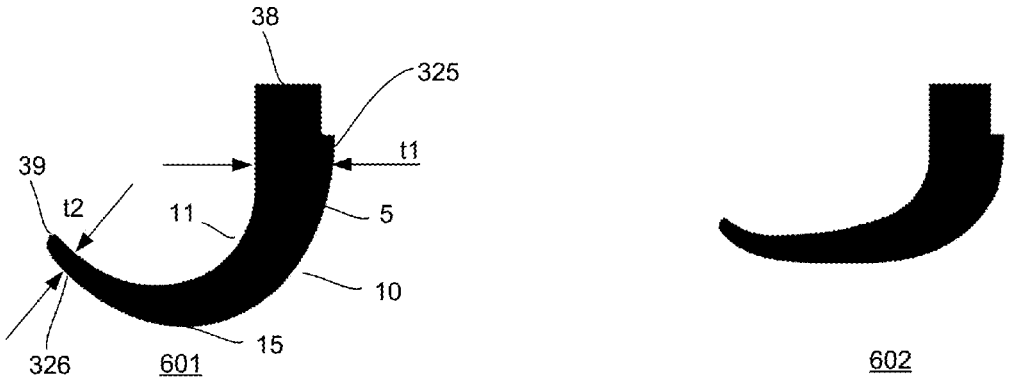
FIG. 6 is a cross sectional view of an alternative profile of an annular elastic base under two selected loads.

FIG. 6 shows an alternative cross sectional shape 601, 602 of the annular elastic base member 5 in an unloaded state and in a loaded state. The annular elastic base member 5 preferably has an inwardly curved cross sectional shape 601, 602. The annular elastic base member 5 may be tapered, having a downwardly decreasing thickness. The thickness of the annular elastic base member 5 may decrease from a first thickness t1 at an upper, substantially cylindrical section 325 of the annular elastic base member 5 to a lower thickness t2 at a lower end section 326 of the annular elastic base member 5. The tapered profile of the annular elastic base member 5 supports the desired load/deformation characteristic as shown in FIG. 5. Thinner portions of the annular elastic base member 5 close to its lower end 39 bend more easily than upper portions close to its upper end 38.

The uneven thickness of the annular elastic base member 5 allows a stool equipped therewith to be used equally by a very light user, such as a child, and a heavy adult. In case of a child, only the lower, thinner, portions of the annular elastic base member 5 will bend. When used by an adult, the thicker, upper, portions of the annular elastic base member 5 will also bend. In both cases the user will experience a similar "feel" of the stool's stabilizing force.

Under extreme load the lower end 39 of the annular elastic base member 5 may bend through completely and come to rest against the base structure 6. This limits the maximum deformation of and prevents damage to the annular elastic base member 5 when exposed to extreme loads.

The annular elastic base member 5 may be shaped outwardly convex and inwardly concave. The downwardly convex outer surface 10 and a downwardly concave inner surface 11 meet at the lower end 39 of the annular elastic base member. The lower end 39 of the annular elastic base member may extend into a stiffening ring 40 as shown in FIG. 4. The stiffening ring 40 at the lower end 39 helps stabilizes the annular elastic base member 5 at the contact area 15. The stiffening ring 40 protects the lower end 39 from kinking when the stool 1 is loaded and/or tilted out of its normal position. The stiffening ring 40 is preferably an integral component of the annular elastic base member 5.

To prevent kinking, the lower end 39 of the annular elastic base member 5 may also be bent upwardly, such that the contact area 15 between the annular elastic base member 5 and the floor is below and radially outward of the lower end 39 of the annular elastic base member 5.

Figure 10:
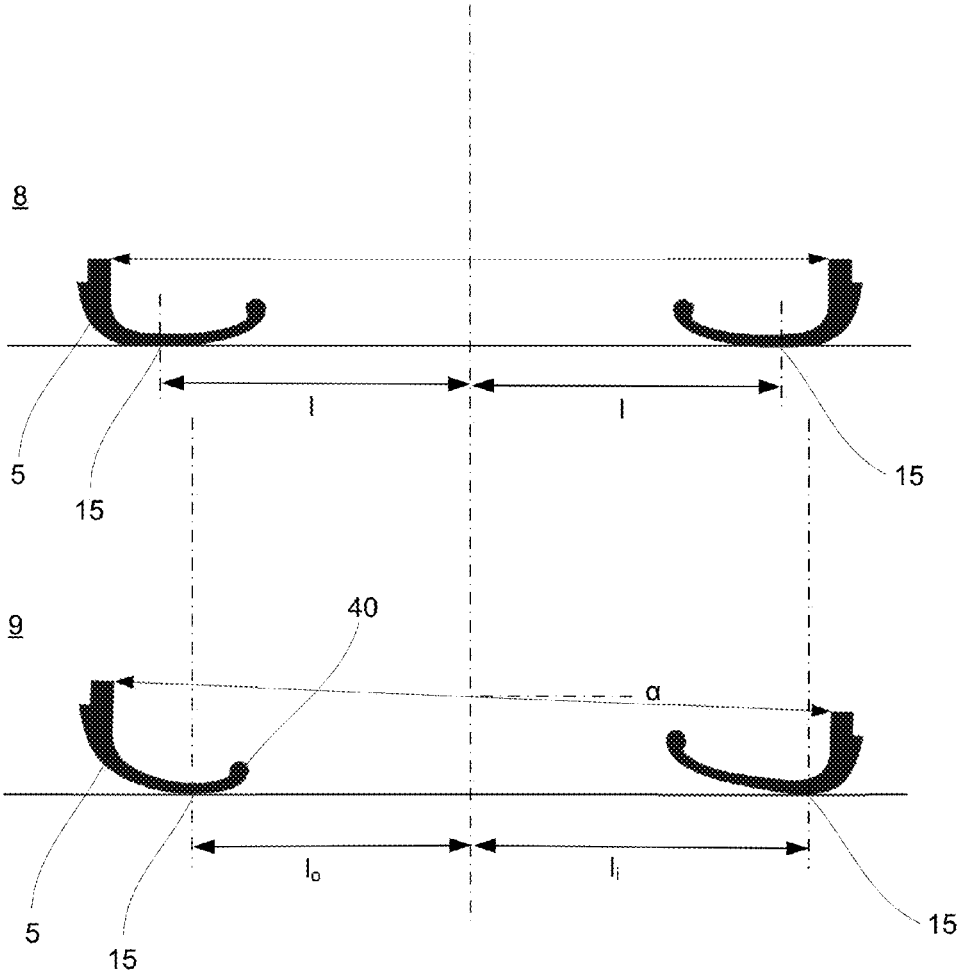
FIG. 10 is a cross section view through an exemplary annular elastic base in a normal (upright) position and in a tilted position.

When a stiffening ring 40 is used to strengthen the lower end 39 of the annular elastic base member 5, the unloaded annular elastic base 5 may contact the floor at the stiffening ring 40 as is shown in FIG. 4. This arrangement has been found beneficial when working with relatively thick material. When using relatively thinner cross sectional shapes it has been found beneficial to provide the unloaded contact area 15 of the annular elastic base 5 radially outwardly and below the stiffening ring 40 as is shown in FIG. 10.

Figure 11:
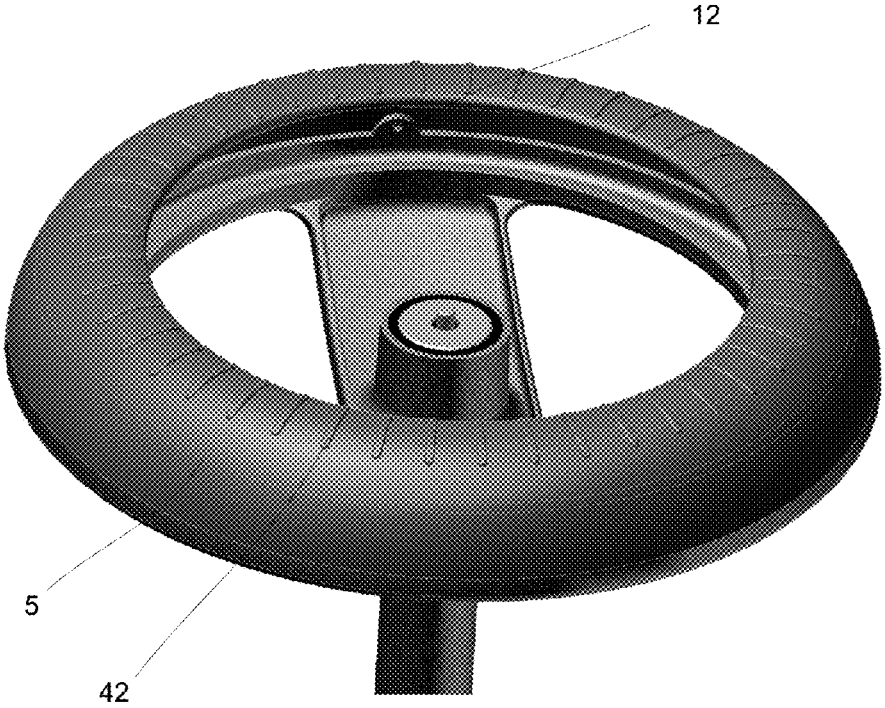
FIG. 11 is a perspective bottom view of an exemplary annular elastic base with additional ridges.

Opposite the lower end 39 an upper end 38 of the annular elastic base member 5 may be formed as a tongue 36 which engages a corresponding groove 37 in the base structure 6. The tongue 36 may be slightly wider than the groove 37 and during assembly the tongue 36 may be press-fitted into the groove 37 with the help of a tool that secures the annular elastic base member 5 during insertion into the base structure 6. The tongue may be further secured with self-tapping screws. As shown in FIG. 11, mounting holes 12 may be provided and are preferably circumferentially spaced at the base structure 6 to secure radially outwardly directed screws into an upper portion of the inner surface 11 of the annular elastic base member 5.

Alternatively, the tongue 36 of the annular elastic base member 5 may be assembled to the groove 37 of the base structure 6 by gluing or welding. In particular, the annular elastic base member 5 may be ultrasonically welded to the base structure 6. Welding may also be achieved by inserting an electrically conductive disc into the groove 37 or by molding an electrically conductive element into the tongue 36. An electric current may then be applied to the electrically conductive disc in order to cause resistive heating. The electric heating causes the surface of the tongue 36 to meld and weld to groove 37.

Yet another assembly option is to cool the annular elastic base member 5 to a temperature significantly below room temperature, causing the tongue 36 to shrink. Cooling may for example be affected by directing a cold gas onto the tongue 36 just before insertion into the groove 37. The groove 37 may be dimensioned such that the cooled tongue 36 can be easily inserted thereto, but is firmly held within the groove 37 once the tongue 36 warms back up to room temperature, expanding within the groove 37. Experiments have shown that load on the stool 1 reinforces the tongue-and-groove connection between the annular elastic base member 5 and the base structure 6, so that reinforcement of the connection by welding or gluing is not critical and may not be necessary at all.

The cross-sectional profile and the material of the annular elastic base member 5 are coordinated to provide a desired seating experience. The annular elastic base member 5 may be made of thermoplastic polyurethane (TPU), rubber, thermoplastic polyolefin (TPO), fiberglass enforced polyamide (PA) or fiberglass enforced polyurethane (PU). The selection of material requires a trade-off decision between cost and functionality. Experiments including durability tests have shown, that a thermoplastic polyurethane with 90 Shore hardness provides the required robustness at an affordable price. An annular elastic base member 5 made of softer TPU with 75 Shore hardness would require about twice the amount of material as one made of TPU with 90 Shore hardness.

Figure 7:
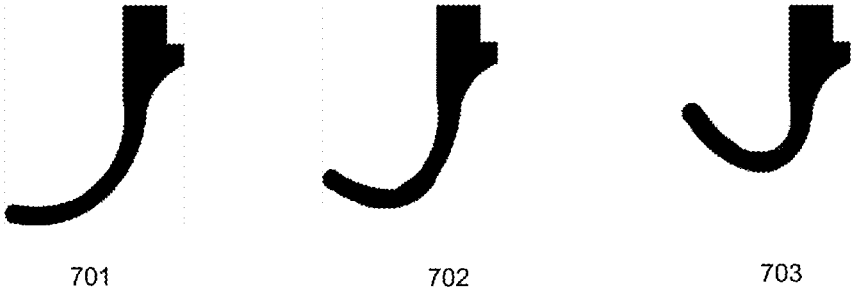
FIG. 7 shows a "j" profile of an annular elastic base under various loads.

The following configuration of the annular elastic base member 5 has been found to be particularly beneficial for users having a weight between 40 kg and 150 kg, which is a typical market requirement:

Material: TPU
Mass: 600 grams
Hardness: 90 Shore
Diameter at the upper end 38: 333 mm
Diameter at the lower end 39: 245 mm
Height h1 without load: 56 mm (including the tongue 36)
Height without load: 48 mm (not including tongue 36)
Tongue 36 dimensions: 8×8 mm
Thickness t1 at an upper section 325: 13 mm
Thickness t2 at a lower section 326: 2 mm
Thickness (diameter) of the stiffening ring 40: 8 mm An alternative substantially "j"-shaped cross-sectional profile 701, 702, 703 of an annular elastic base member 5 under three different loads is shown in FIG. 7. This profile may be used in combination with harder materials such as fiber-enforced polyamide or polypropylene. The shown "j"-shaped profile 701, 702, 703 has a more even thickness and consequently bends more readily compared to the tapered profile 601 shown in FIG. 6. While this is generally not preferred as it increases the risk of kinking, the "j"-shaped profile 701, 702, 703 may be manufactured more cost effectively, and may hence be a viable alternative for cost sensitive products.

Figure 8:
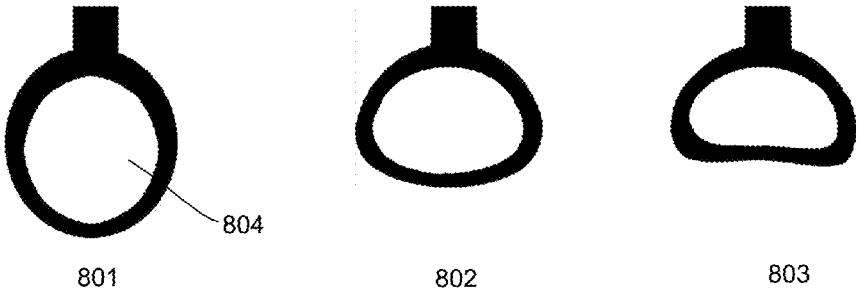
FIG. 8 shows an "o" profile of an annular elastic base under various loads.

Yet another alternative cross-sectional profile 801, 802, 803 is substantially "o"-shaped as shown in FIG. 8. An annular elastic base member 5 having a substantially "o"-shaped cross-sectional profile 801 may be manufactured by extrusion, and thus be an alternative to molded profiles. Alternatively, the annular elastic base member 5 having a substantially "o"-shaped cross-sectional profile 801 may be formed by rotational molding or by blow molding. The substantially "o"-shaped profile 801 may comprise a cavity 804 which may be filled with air or another gas and may be pressurized.

Figure 9:
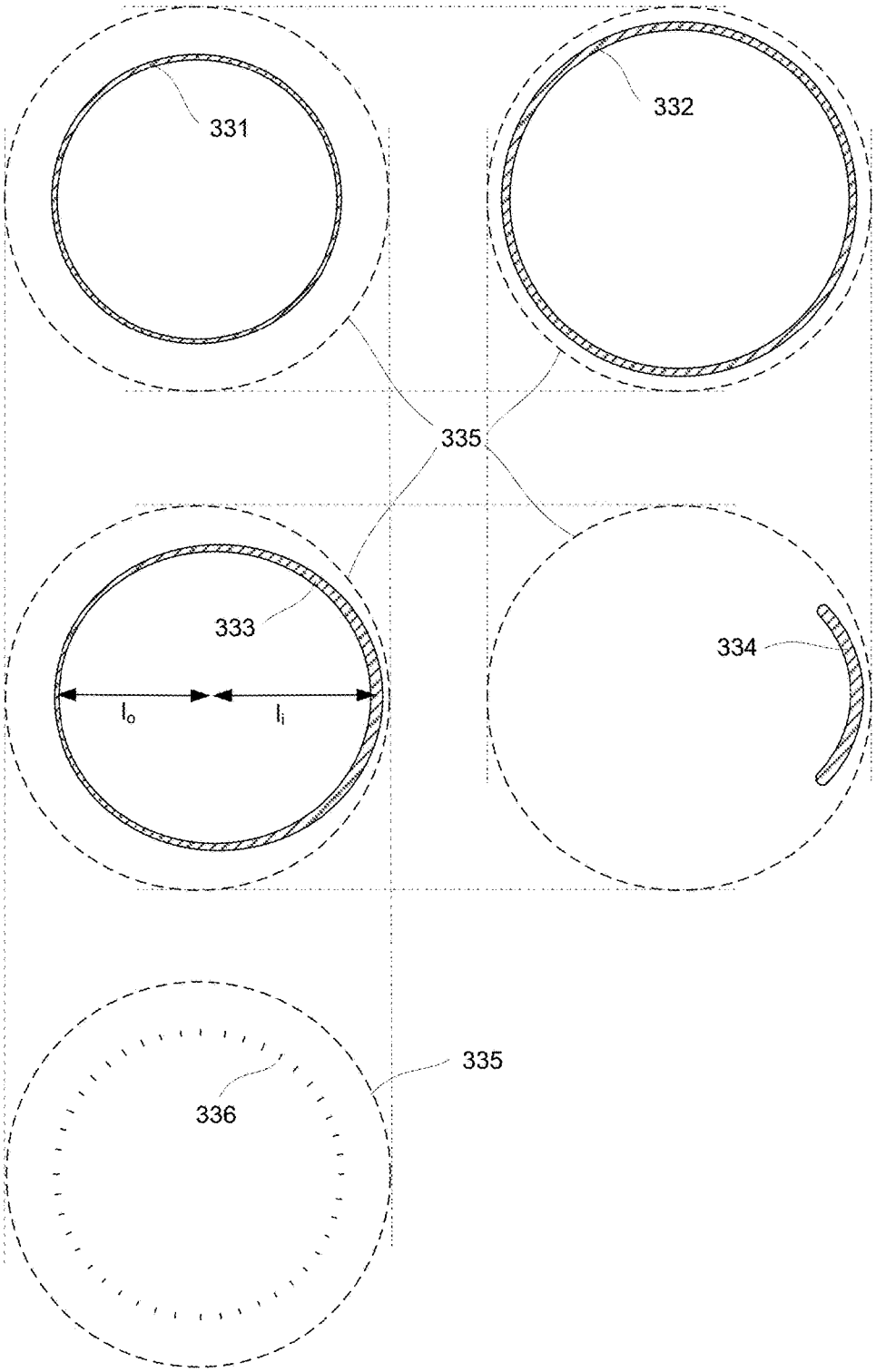
FIG. 9 shows exemplary contact areas of the annular elastic base with the floor under various loads.

FIG. 9 illustrates the shape of the contact area 15 of the annular elastic base 5 with the floor 14 under various loads. An unloaded stool may have a contact area 15 that assumes a first circular shape 331. For reference, the position 335 of the upper end 38 of the annular elastic base member 5 is shown in a dashed line in FIG. 9. When the stool is symmetrically loaded and upright the contact area grows outwardly but remains circular. Consequently, the contact area 15 may assume a second circular shape 332 that has larger diameter than the first circular shape 331 when additional weight is placed on the stool. When tilted, the contact area may assume a substantially oval shape 333. As shown, the substantially oval shaped contact area 333 has a longer inner lever $l_i$ than outer level $l_o$. The inner level $l_i$ is measured from the intersection of the vertical axis 13 with the floor 14 to the contact area in the direction of the tilt. The outer lever $l_o$ is measured from the intersection of the vertical axis 13 with the floor 14 to the contact area in the direction opposite the tilt. The contact area 15 remains within the confines of the position 335 of the upper end 38 of the annular elastic base member 5 under all loads, and whether loaded symmetrically or asymmetrically.

When the an annular elastic base member 5 is used with additional circumferentially spaced radially extending ridges 42, the contact area 15 consists of a plurality of circumferentially spaced radially extending surfaces 336 that are arranged in an approximately circular shape 331, 332 or approximately oval shape 333 as explained above.

The stool may be tilted beyond its dynamic seating envelope of about 10 degrees. In that case the substantially oval shaped contact area 333 opens up at the inner end and eventually assumes an approximately crescent-shape 334. When tilting the stool beyond its dynamic seating envelope a user will remain a stable position by applying force to his legs. Advantageously, the so tilted stool does not have a tendency to roll sideways. Further, the elasticity of the annular elastic base provides good friction on the floor and thus prevents the stool from sliding backward.

When in its upright position the annular elastic base member 5 has a substantially ring-shaped, circular, contact area 15 with the floor. Increasing deformation of the annular elastic base member 5 causes the diameter of this ring-shaped contact area 15 to grow outwardly. This increases the effective lever arm 1 of the annular elastic base member 5. When the stool 1 is tilted out of its normal position the contact area 15 changes from a circular shape toward an approximately oval shape. Beneficially, the effective inner lever $l_i$ in the direction of the tilt is growing larger, while the effective outer lever $l_o$ opposite the direction of tilt is getting smaller. This effect amplifies the stabilizing force of the stool and contributes to its stability.

The shape of the contact area as shown in FIG. 9 is further illustrated in the cross sectional view of FIG. 10. Here, the annular elastic base 5 is shown in a symmetrically loaded or upright position 8 and in a tilted position 9. In the tilted position 9 the annular elastic base member 5 is tilted by an angle $\alpha$ out of the upright position 8. The comparison of the symmetrically loaded upright position 8 with the tilted position 9 shows the relative change of the inner lever $l_i$ and the outer level $l_o$. As shown, the inner lever $l_i$ grows in the direction of the tilt and the outer lever $l_o$ becomes shorter in the direction opposite the tilt.

The maximum elastic deformation of the annular elastic base member 5 may allow spring-loaded tilt of the stool of up to about 10 degrees and be associated with the equivalent of a symmetrical load of 200 kg. A user may tilt the stool beyond its dynamic seating envelope up to about 45 degree. This is achieved by lifting the backward portion of the annular elastic base member 5 into the air. Tilting the stool up to about 45 degrees allows a user to conveniently pick up articles from the floor. The shape of the annular elastic base member as described before provides a relatively smooth and seamless transition from dynamic deformation (up to approximately 10 degrees) to lifting the backward portion of the base into the air (between approximately 10 degrees and 45 degrees).

FIG. 11 shows an annular elastic base member 5 with additional circumferentially spaced radially extending ridges 42 at the contact area of the annular elastic base with the floor. The radially extending ridges 42 have been found to prevent noise that might otherwise be caused by deformation of the annular elastic base member 5. Noise may stem from vibrations that may be caused when the annular elastic base member 5 deforms while a user tilts the associated stool. The radially extending ridges 42 may also prevent a vacuum from forming under a stool equipped with the annular elastic base member 5. This is particularly relevant if the annular elastic base member 5 and the base structure 6 form an upwardly sealed surface. In that case, the annular elastic base member 5 and the base structure 6 could act a large suction cup, which must be prevented. Prevention is achieved by the ridges 42 which segment the contact area of the annular elastic base 5 with the floor 14 and allow air to pass through air channels between the ridges 42. Instead of ridges 42, grooves (not shown) may be applied to the annular elastic base member 5 in an equivalent circumferentially spaced and radially extending arrangement to provide the desired air channels. FIG. 11 shows a configuration with 44 ridges. Alternative configurations may choose to use more or fewer ridges, for example between 20 and 80 ridges.

Figure 12:
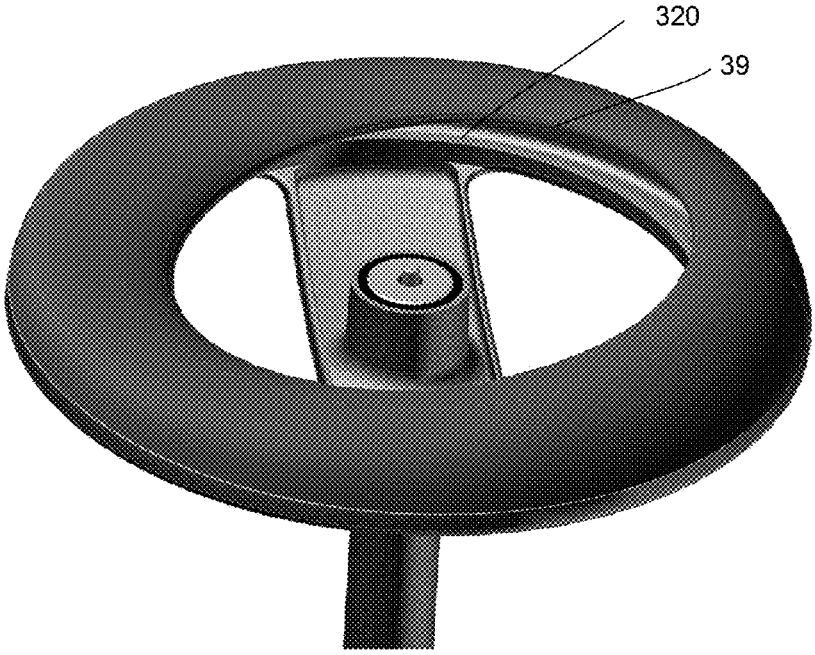
FIG. 12 is a perspective bottom view of an exemplary annular elastic base in a tilted position.

FIG. 12 shows a deformed annular elastic base member 5 under extreme load. The lower end 39 of the annular elastic base member 5 here bends through completely and comes to rest against a stop surface 320 of the base structure 6. This limits the maximum deformation and thereby prevents damage of the annular elastic base member 5 when exposed to extreme loads. The extremely loaded stool remains slightly elastic based on compression of the material of the annular elastic base 5. Damage to the floor is prevented as the base structure 6 does not contact the floor even under extreme load.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims. For example, while this specification and the claims refer to a stool, it should be understood that the invention can equally be applied to a chair or other tiltable article of furniture.

Alternative Embodiments

A tiltable stool, comprising:

a seat;

an annular elastic base member; and an elongated body structure extending between the seat and the base.

The tiltable stool as above, wherein the annular elastic base is rotationally symmetrical.

The tiltable stool as above, wherein the annular elastic base member comprises a downwardly convex outer surface and a downwardly concave inner surface extending around a central opening.

The tiltable stool as above, further comprising a height adjustment mechanism.

The tiltable stool as above, wherein the elongated body structure comprises a pillar assembly and defines a vertical axis of the stool.

The tiltable stool as above, wherein the annular elastic base member is an integral molded component.

The tiltable stool as above, wherein the annular elastic base member rests on the floor.

The stool as above, wherein the stool can be tilted in any direction by deforming the annular elastic base.

The stool as above, wherein the stool can be tilted in any direction by deforming the annular elastic base within a dynamic seating enveloped of approximately 10 degree tilt.

The stool as above, wherein the stool can be tilted beyond the dynamic seating envelope by lifting a backward portion of the annular elastic base into the air.

The stool as above, wherein the stool wherein the stool has an upright normal position.

The stool as above, wherein deformation and/or compression of the annular elastic base member causes a stabilizing force.

The stool as above, wherein the stabilizing force increases with the weight of a user.

The stool as above, wherein the stabilizing force at a given tilt angle increases approximately linearly with the weight of a user.

The stool as above, wherein the stabilizing force increases with the tilt angle of the stool.

The stool as above, wherein the stabilizing force increases approximately exponentially with the tilt angle of the stool.

The stool as above, wherein the height of the annular elastic base member decreases in the direction of tilt when the stool is tilted.

The stool as above, wherein the height of the annular elastic base member increases in the direction opposite tilt when the stool is tilted.

The stool as above, wherein a tongue is formed at an upper end of the annular elastic base member.

The stool as above, wherein the tongue engages a corresponding groove in the base.

The stool as above, wherein the tongue has a height of approximately 8 mm and a thickness of approximately 8 mm.

The stool as above, wherein the tongue is press-fitted into the groove.

The stool as above, wherein the stool is configured to support a user having a weight between 40 kg and 150 kg.

The stool as above, wherein the annular elastic base is configured to support a load between approximately 400 N/m and 1500 N/m.

The stool as above, wherein the annular elastic base member has an inwardly curved cross section.

The stool as above, wherein the annular elastic base member is tapered having a downwardly decreasing thickness.

The stool as above, wherein the annular elastic base member is tapered having a downwardly decreasing thickness.

The stool as above, wherein the annular elastic base member is made of thermoplastic polyurethane.

The stool as above, wherein the annular elastic base member has a mass of approximately 600 grams.

The stool as above, wherein the annular elastic base member has a hardness of approximately 90 Shore.

The stool as above, wherein the annular elastic base member has a diameter at the upper end of approximately 333 mm.

The stool as above, wherein the annular elastic base member has a diameter at the lower end of approximately 245 mm.

The stool as above, wherein the annular elastic base member has a diameter at the upper end that is approximately 1.4 times its diameter at the lower end.

The stool as above, wherein the annular elastic base member has a diameter at the upper end that is between 1.2 and 1.6 times its diameter at the lower end.

The stool as above, wherein the annular elastic base member has height h1 without load of approximately 56 mm including a tongue.

The stool as above, wherein the annular elastic base member has height without load of approximately 48 mm, not including a tongue.

The stool as above, wherein the annular elastic base member has a thickness t1 at its upper end of approximately 13 mm.

The stool as above, wherein the annular elastic base member has a thickness t2 at its lower end of about 2 mm.

The stool as above, wherein a lower end of the annular elastic base member touches a stop surface when fully deformed under heavy load.

The stool as above, wherein deformation of the annular elastic base is limited by a stop surface in the base which supports the lower end of the annular elastic base under heavy loads.

The stool as above, wherein the annular elastic base is secured to the base by screws.

The stool as above, wherein the annular elastic base is secured to the base by self-tapping screws.

The stools as above, wherein mounting holes are provided and circumferentially spaced at the base structure to secure radially outwardly directed screws into an upper portion of the inner surface of the annular elastic base member.

The stools as above, wherein the lower end of the annular elastic base member is bent upwardly, such that the contact area between the annular elastic base member and the floor is below and radially outward of the lower end of the annular elastic base member.

The stool as above, wherein a stiffening ring is provided at the lower end of the annular elastic base member.

The stool as above, wherein the stiffening ring has a diameter of approximately 8 mm.

The stool as above, wherein the annular elastic base member contacts the floor at the stiffening ring when the stool is unoccupied.

The stool as above, wherein the annular elastic base member contacts the floor radially outwardly and axially below the stiffening ring when the stool is unoccupied.

The stool as above, wherein the annular elastic base member has an approximately circular contact area with the floor when the stool is upright.

The stool as above, wherein the radius of the approximately circular contact area with the floor increases as weight is placed onto the stool.

The stool as above, wherein the contact area of the annular elastic base member with the floor is approximately oval when the stool is tilted.

The stool as above in a tilted position, wherein an outer lever $l_o$ measured from the intersection of the vertical axis with the floor to the contact area in the direction opposite the tilt is shorter than an inner lever $l_i$ measured from the intersection of the vertical axis with the floor to the contact area in the direction of the tilt.

The stool as above, further comprising circumferentially spaced radially extending ridges at the contact area of the annular elastic base with the floor.

The stool as above, comprising between 20 and 80 ridges.

The stool as above, further comprising circumferentially spaced radially extending grooves at the contact area of the annular elastic base with the floor.

The stool as above, comprising between 20 and 80 grooves.

What is claimed is:

1. A tiltable stool, comprising:

a seat;

a base comprising an annular elastic base member having a downwardly convex outer surface and a downwardly concave inner surface; and a body structure extending between the seat and the base, wherein the annular elastic base member has a tapered cross-sectional shape with downwardly decreasing thickness and wherein deformation of the annular elastic base member causes a stabilizing force which pushes the tiltable stool towards a normal position when the tiltable stool or chair is tilted out of the normal position.

2. The tiltable stool as in claim 1, wherein the base further comprises a base structure, and wherein an upper section of the annular elastic base member is substantially cylindrical and firmly connected to the base structure.

3. The tiltable stool as in claim 2, further comprising a plurality of mounting holes circumferentially spaced at the base structure through which radially outwardly directed screws engage the upper section of the annular elastic base member.

4. The tiltable stool as in claim 2, wherein a lower end of the annular elastic base member contacts the base structure when the annular elastic base member is fully deformed.

5. The tiltable stool as in claim 1, wherein a lower section of the downwardly convex outer surface of the annular elastic base member rests on the floor.

6. The tiltable stool as in claim 5, wherein a contact area between the annular elastic base member and the floor is substantially ring-shaped, and wherein the contact area grows outwardly when a weight is placed on the seat.

7. The tiltable stool as in claim 1, wherein the annular elastic base member has a generally "j"-shaped cross section.

8. The tiltable stool as in claim 1, wherein the normal position is upright.

9. The tiltable stool as in claim 8, wherein the outer surface of an upper section of the annular elastic base member is substantially vertical.

10. The tiltable stool as in claim 1, wherein the base further comprises a base structure and wherein the annular elastic base member comprises a circular tongue at its upper end which engages a corresponding circular groove of the base structure.

11. The tiltable stool as in claim 10, wherein the circular tongue is press-fitted into the corresponding circular groove.

12. The tiltable stool as in claim 10, wherein the annular elastic base member is inserted into the circular groove of the base structure by cooling the annular elastic base to reduce the size of the tongue.

13. The tiltable stool as in claim 1, wherein the annular elastic base member comprises thermoplastic polyurethane with a hardness of about 90 Shore.

14. The tiltable stool as in claim 1, wherein the annular elastic base member comprises a plurality of circumferentially spaced and radially extending grooves or ridges in a contact area with a floor.

15. A tiltable stool, comprising:

a seat;

a base comprising a rotationally symmetrical annular elastic base member with a generally "j"-shaped cross section having a downwardly convex outer surface and a downwardly concave inner surface extending around a central opening; and an elongated body structure extending between the seat and the base.

16. The tiltable stool as in claim 15, wherein the tiltable stool has a substantially upright position when not subjected to a tilting force, and wherein the tiltable stool can be tilted away from the upright position into a dynamic seating position by a tilting force, and wherein deformation of the annular elastic base member causes a stabilizing force which pushes the tiltable stool against the tilting force from the dynamic seating position towards the upright position.

17. The tiltable stool as in claim 16, wherein the stabilizing force increases with a tilt angle between the dynamic seating position and the upright position.

18. The tiltable stool as in claim 17, wherein the stabilizing force increases approximately exponentially with the tilt angle.

19. The tiltable stool as in claim 16, wherein the stabilizing force increases with a weight that is applied to the seat.

20. The tiltable stool as in claim 15, wherein the annular elastic base member is tapered, having a downwardly decreasing thickness of approximately 13 mm at an upper end and of approximately 2 mm at a lower end, and wherein the annular elastic base member is made of thermoplastic polyurethane having a hardness of approximately 90 Shore, and wherein the upper end of the annular elastic base member has a diameter of approximately 333 mm, and wherein the lower end of the annular elastic base member has a diameter of approximately 245 mm, and wherein a stiffening ring having a thickness of approximately 8 mm is provided at the lower end of the annular elastic base member.

21. A tiltable stool, comprising:

a seat;

a base comprising a base structure and an annular elastic base member having a downwardly convex outer surface and a downwardly concave inner surface, the outer surface and the inner surface extending from an upper end to a lower end, the upper end of the annular elastic base member being firmly connected to the base structure; and a body structure extending between the seat and the base, wherein deformation of the annular elastic base member causes a stabilizing force which pushes the tiltable stool towards a normal position when the tiltable stool or chair is tilted out of the normal position and wherein the annular elastic base member has a diameter at the upper end that is between 1.2 and 1.6 times its diameter at the lower end.

* * * * *